United States Patent [19]

Kürner et al.

[11] 4,331,008

[45] May 25, 1982

[54] THREAD CONTROL IN TEXTILE MACHINES

[75] Inventors: Heinrich Kürner, Albstadt; Manfred Keinath, Burladingen, both of Fed. Rep. of Germany

[73] Assignee: Gebrueder Frei GmbH & Co., Albstadt-Onstmettingen, Fed. Rep. of Germany

[21] Appl. No.: 142,021

[22] Filed: Apr. 21, 1980

[30] Foreign Application Priority Data

Sep. 11, 1979 [DE] Fed. Rep. of Germany ..... 2936581

[51] Int. Cl.[3] ..... D04B 35/12; D04B 35/14

[52] U.S. Cl. ..... 66/163; 28/222

[58] Field of Search ..... 66/161, 163; 28/187, 28/222, 225, 232; 200/61.14, 61.18; 242/36

[56] References Cited

U.S. PATENT DOCUMENTS

| | | | |
|---|---|---|---|
| 1,353,476 | 9/1920 | Holt et al. | 28/222 X |
| 2,178,982 | 11/1939 | Wachsman | 200/61.14 |
| 2,257,030 | 9/1941 | Antonevich | 66/163 |
| 2,290,303 | 7/1942 | Vossen | 200/61.18 X |
| 2,419,518 | 4/1947 | Eichinger | 200/61.18 |
| 2,467,366 | 4/1949 | Arrowood | 66/163 |
| 2,654,238 | 10/1953 | Heyne | 66/163 |
| 2,881,982 | 4/1959 | Miller | 242/36 |
| 2,950,520 | 8/1960 | Sonnino | 200/61.14 X |
| 3,390,553 | 7/1968 | Mishcon | 66/161 |
| 3,689,963 | 9/1972 | Frei | 66/163 X |
| 3,806,677 | 4/1974 | Deniega et al. | 66/163 X |
| 3,867,592 | 2/1975 | Quellos | 200/61.18 |
| 3,999,717 | 12/1976 | Jacobsson | 66/132 R |

*Primary Examiner*—Wm. Carter Reynolds
*Attorney, Agent, or Firm*—Michael J. Striker

[57] ABSTRACT

A thread monitor for use in textile machines monitors thread tension (i.e. to detect thread breakage or relaxation) and the presence of knots in the thread. If either is detected the monitor issues a signal and shuts down the associated textile machine. The device can be adjusted for different thread tensions, different thread thicknesses and different knot sizes. To prevent difficulties due to electrostatic charging the main elements of the monitor are connected to a grounding terminal.

9 Claims, 5 Drawing Figures

THREAD CONTROL IN TEXTILE MACHINES

BACKGROUND OF THE INVENTION

This invention relates to thread control in textile machines, particularly knitting machines.

Textile machines generally process large numbers of individual threads at once, to convert these threads into textile material. If even one of these many threads breaks, is too loose (i.e. inadequately tensioned) or has knots, this will be immediately reflected in form of a defect in the textile being produced. Therefore, the threads must be monitored for the occurrence of one or more of these conditions and, where such a condition is detected, must result in immediate shut-down of the machine until the problem can be corrected.

Equipment for this purpose is known. It utilizes a tension arm which maintains the respective thread at an essentially constant tension in its passage through the machine. To detect the presence of knots, another arm is provided which is movable and past which the thread travels; a knot in the thread then entrains this movable arm, pivoting it about an axis and causing the machine to be shut down due to interruption of the motor circuit.

The prior-art equipment of this type is, however, not fully satisfactory in all applications, especially not with respect to its use in conjunction with threads (the term is intended to include filaments and yarns) of different thickness.

SUMMARY OF THE INVENTION

Accordingly, it is an object of the invention to overcome the prior-art disadvantages.

A more particular object is to provide an improved thread monitor for textile machines.

Still another object is to provide a textile-machine thread monitor which is capable of monitoring threads irrespective of their greater or lesser thickness.

Pursuant to these objects, and still others which will become apparent hereafter, one aspect of the invention resides in a thread-monitoring device for textile machines. Briefly stated, such a device may comprise a thread monitor for use with textile machines, particularly knitting machines, comprising a thread brake for the running thread; a knot sensor for detecting knots in the thread; and means for detecting a loss of tension in the running thread, comprising a thread-engaging tension arm, a cam a turntable to and from an activated position in which it interrupts an electrical circuit of the textile machine, a coupling element coupling the arm with the cam so that displacement of the arm from a monitoring position to an indicating position effects turning of the cam to the activated position thereof, and spring means urging the cam to the monitoring position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
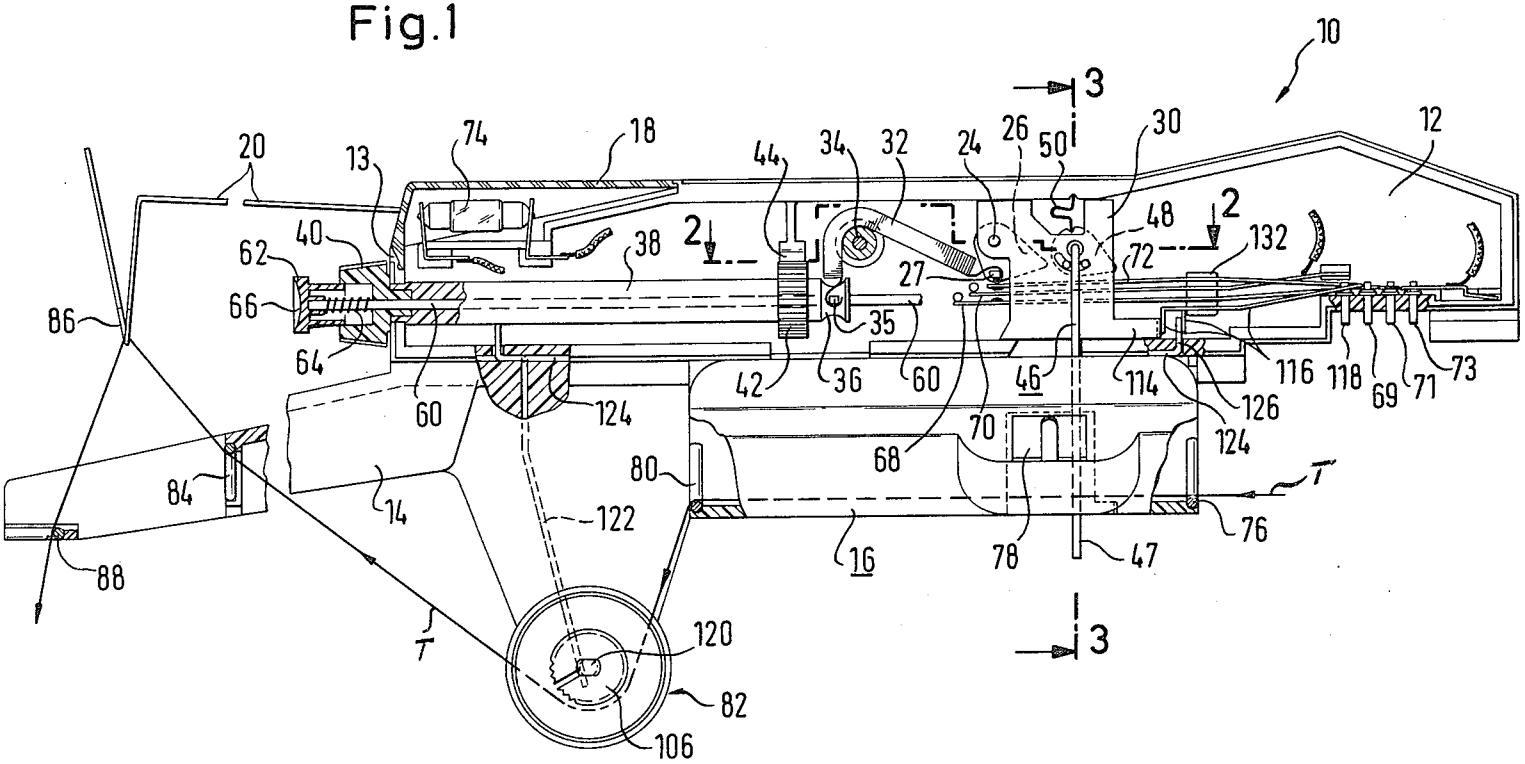
FIG. 1 is a somewhat diagrammatic vertical longitudinal section through a thread-monitoring device according to the invention.
Figure 2:
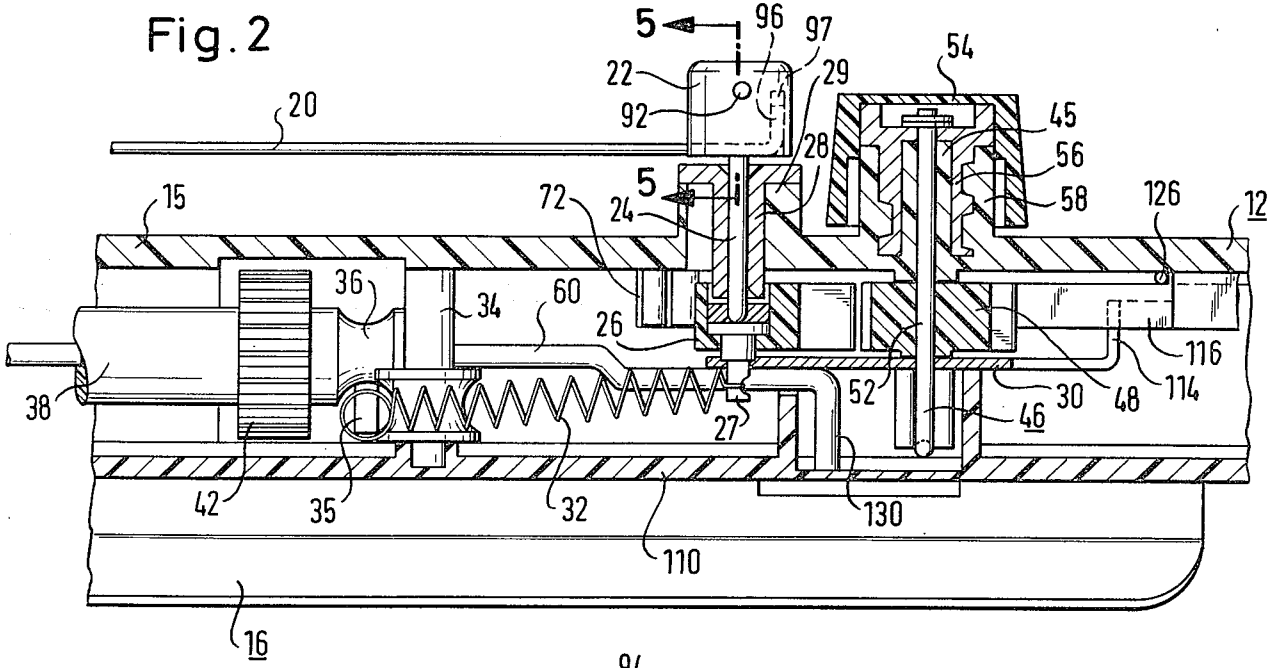
FIG. 2 is a section on line 2—2 of FIG. 1.
Figure 3:
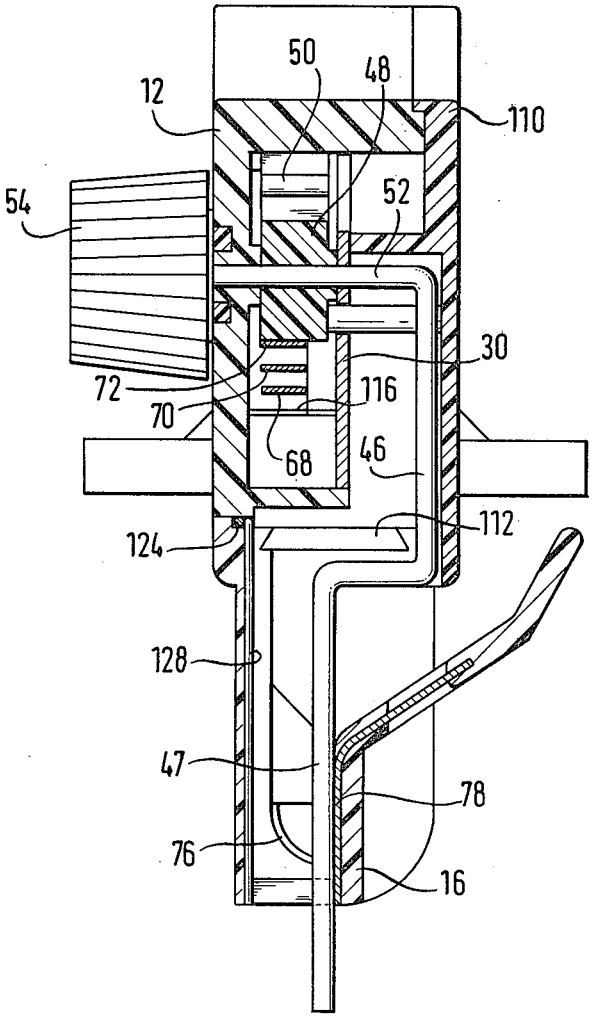
FIG. 3 is a section on line 3—3 of FIG. 1.

The thread monitoring device 10 in FIGS. 1–5 has a housing 12 provided with a cover 110 (FIGS. 2–3) which is shown removed in FIG. 1. A holder 14 for a thread brake 82 and a thread guide 16 are mounted on the lower side of housing 12. To facilitate attachment and detachment of the elements 14 and 16 and eliminate the need for separate connectors it is advisable for the mounting to be effected in an undercut groove in the housing and corresponding mating projections on the elements 14, 16, or vice versa. In FIG. 3 this is shown by way of example at 112 for the element 16.

The upper side of housing 12 is provided with a hood 18 of transparent or translucent synthetic plastic material which advantageously has a red tint. Beneath the hood 18 the device has an indicator lamp 74 which becomes energized (in a manner still to be discussed) when malfunctions or flaws are detected and thus provides an appropriate indication to the operator.

FIG. 2 shows particularly well that the rear wall 15 of housing 12 has a tension arm 20 pivotably mounted on it. A coupling member 22 connects arm 20 with the shaft 24 of a cam 26. The cam 26 is located in the housing 12 whereas member 22 is located outside it. Shaft 24 is turnably journalled in a sleeve 28 which is mounted in a socket 29 projecting out from the rear wall of housing 12. The front end of shaft 24—or of an extension connected with the shaft—extends into a bore of a member 30 which may e.g. be of brass; the purpose of this arrangement will become apparent later on. The cam 26 is mounted on the shaft 24 to turn with but not relative to the same; it is located between the member 30 and the rear wall 15 of housing 12 and provided with a portion 27 located within the housing. A spring 32 is connected at one end to the portion 27 and guided around a bolt 34 which extends normal to the plane of the rear housing wall; the other end of the spring 32 is connected to a projection 35 of a roll 36 having an axis which extends parallel to the rear housing wall.

A sleeve 38 extends lengthwise through the housing 12 and projects outwardly beyond the front end wall 13 thereof, where it carries a control knob 40. Roll 36 is either formed of one piece with sleeve 38 or connected to the same. By turning of the knob 40 the spring 32 can thus be tensioned to a greater or lesser extent which, in turn, means that the tension arm 20 may thus be adjustably biased counter to the direction of pull exerted by the advancing thread.

In addition to the roll 36 the sleeve 38 also carries (or is of one piece with) a gear 42 which cooperates with a detent on the housing 12 (FIG. 1). The spring 32 acts upon the roll 36 and thus permanently pulls the gear 42 against the detent 44, so that the letter enters into the space between successive teeth of the gear 42; the position of the roll 36 (and of spring 32) as set by turning of the knob 40, is thus fixed by the cooperation of gear 42 and detent 44. However, when knob 40 is turned the gear 42 yields downwardly and disengages from the detent 44 for the duration of its movement, to re-engage therewith and become blocked thereby as soon as the turning movement ceases.

Also provided on the rear wall 15 and projecting rearwardly of the housing, is a bore 45 in which a horizontally extending part 52 of a feeler arm 46 is turnably journalled. A sleeve 56 is mounted on the bore 45 and has an external thread which meshes with an internal thread of a tubular socket 58 which is of one piece with rear wall 15 and so located as to surround the bore 45. A knob 54 is mounted on the sleeve 56 in motion-transmitting relationship, so that turning of the knob 54 causes consequent turning of the sleeve 56 and its axial displacement relative to the socket 58. Since the part 52 is coupled with the sleeve 56 so as to share the axial displacement, the arm 46 is thus shifted axially of the socket 58 to accommodate it to different thread thicknesses or knot sizes, as will be explained later.

A cam 48 is mounted on part 52 intermediate wall 15 and element 30; it is turnable with the part 52 which, as shown in FIG. 2, penetrates the element 30 before it is angled in downward direction to become the actual arm 46. The lower end 47 of this arm is located opposite a thread guide baffle 78 (FIG. 3); as will be explained later, the thread T passes between lower end 47 and baffle 78 (FIG. 1). An omega spring 50 (FIG. 1) has its two ends engaged in notches of the upper wall of housing 12 and of the cam 48, respectively, so that—when arm 46 is entrained in clockwise direction in FIG. 1 by a knot in thread T—the spring 50 permits the cam 48 to snap from the position of FIG. 1 into its switching position.

Having once been displayed by a knot from the FIG. 1 position in clockwise direction, the arm 46 can be returned to its illustrated (FIG. 1) rest position by a plunger 60 which is slidably mounted in the sleeve 38 coaxial thereto. The plunger extends beyond the rear open end of the sleeve 38 (FIG. 2) and has an end portion 130 which extends normal or substantially normal to the remainder of the plunger. The front end of the plunger 60 is connected with a pushbutton 62 (FIG. 1) which is biased to the illustrated position by a spring 64 which surrounds the front end of the plunger and reacts between the button 62 and the knob 40. The outer end face of button 62 may be provided with a depression 66, so that the button can be operated with a tool rather than by finger pressure, for example with a rod or the like if the device is mounted on a textile machine at substantial height where the button is not otherwise readily accessible. Depressing of the button 62 in rightward direction of FIG. 1 causes the plunger 60 to be shifted in the same direction, so that the end portion 130 pushes the cam 48 back to its rest position. Upon release of the button 62 the spring 64 returns the plunger 60 to the starting position shown in FIG. 1.

Three springy electrical contacts 68, 70 and 72 are arranged in the housing 12 and connected to terminals 69, 71 and 73, respectively. These latter extend through the bottom wall of housing 12 to the exterior thereof, to be connected to a not-illustrated source of electrical energy. Contacts 68, 70 and 72 are secured in a housing-mounted retainer 132; due to their springy character they resiliently hold the terminals 69, 71 and 73 in openings of the bottom wall of the housing. Lamp 72 is also connected with the contacts, but the electrical connection is not shown because it is known per se and also to simplify the illustration.

The thread T passes through the device in the direction indicated by the arrowheads. At the inlet and at the outlet of the device respective upwardly open U-shaped thread guiding brackets 76, 80 are provided. In its path through the device the thread travels between the baffle 78 and the end portion 47 of arm 46 and from there through the thread brake 82 (se FIG. 4). From brake 82 the thread passes through a guide bracket 84 shaped as an inverted U, then through an eye 86 of arm 20 and finally through a generally horizontal U-shaped bracket 88 the open side of which faces left in FIG. 1.

Figure 4:
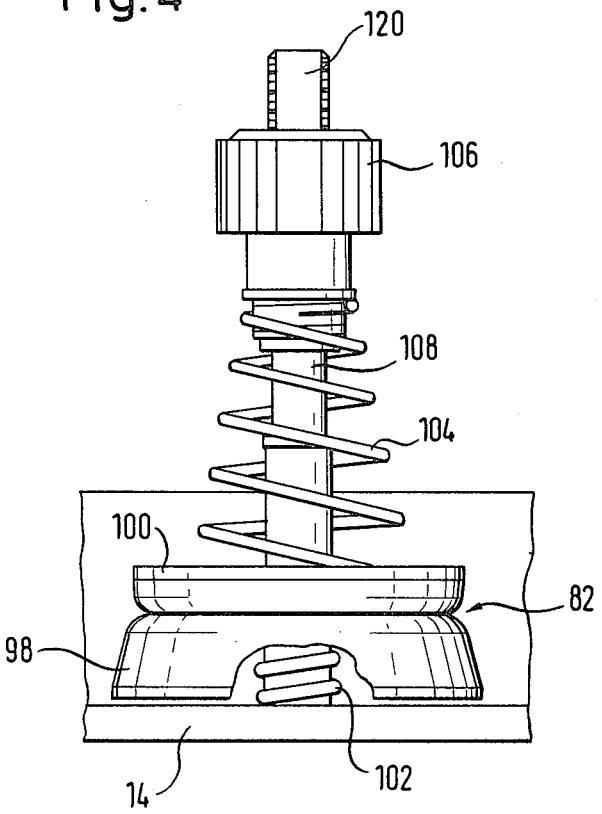
FIG. 4 is a bottom-plan view, showing a detail of FIGS. 1–3.

As shown in FIG. 4 the brake 82 has two juxtaposed brake disks 98, 100. The surface of disk 98 which faces disk 100 is smooth, e.g. polished, whereas the corresponding surface of disk 100 is slightly rough, as is known per se. A relatively strong spring 102 presses disk 98 against a shoulder (not shown) of a pin 108, so tht it can turn only reluctantly. A weaker spring 104, e.g. an elliptical spring, presses disk 100 against disk 98. The prestress of spring 104 can be freely selected by turning a nut 106 which is threaded onto a threaded portion of pin 108; thus, the force with which disk 100 is pressed against disk 98 can be selectively increased or decreased. Nut 106 may be of synthetic plastic material and is provided with a longitudinal slot (not shown) which extends from outside all the way to the internal thread which has a somewhat smaller diameter than the outer diameter of the thread on pin 108. The nut 106 is therefore seated on the pin 108 under tension, making it self-locking. The thread T (not shown in FIG. 4) is passed between the disks 98, 100; due to the slight roughness of its surface the disk 98 is entrained by the thread, causing the disk 98 to turn slowly; due to this movement the thread brake has a self-cleaning action.

Figure 5:
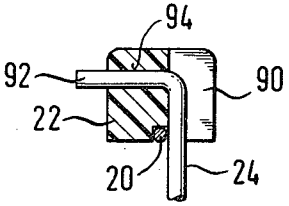
FIG. 5 is a section on line 5—5 of FIG. 2.

Coupling member 22 is of substantially cylindrical shape (FIG. 2) and provided with a slot 90 (FIG. 5) which extends over its entire axial length and penetrates from the outer surface radially inwardly to—or substantially to—the central longitudinal axis of member 22. In addition, the member 22 is formed with a radial passage 94 which extends from the slot 90 radially outwardly to the circumference of member 22. The shaft 24 has an end portion 92 which is angled off at about 90° relative to the remainder of the shaft; the part of the shaft adjacent end portion 92 is received in the slot 90 (FIG. 5) whereas the end portion 92 itself is received in passage 94. This establishes a connection which prevents relative displacement of the components 22 and 24 in axial direction, in rotational direction of component 24 and in a rotational direction opposite thereto. Indicated in FIG. 5, but more clearly shown in FIG. 2, is the fact that an end portion of arm 20 is received in a groove formed in an endface of the member 22 and has a part 96 which is bent over at substantially a right angle. This part 96 extends into an axially extending blind bore 97 of member 22. FIG. 5 shows that the arm 20 actually contacts the shaft 24 where the two meet in the member 22.

It is known that as the thread T passes through a device of the type under discussion, electrostatic charges may develop which can lead to high potential-differences; a sudden discharge of these charges may lead to the destruction of parts of the device or at least to malfunctions in the electrical or electronic controls of the textile machine. To avoid this the invention proposes the use of a ground connector 118 in form of a pin-type terminal similar to the terminals 69, 71, 73. The arm 20, brake 82, arm 46, 47 and the baffle 78 are all electrically conductively connected to the terminal 118.

In the case of the arm 20 this connection takes place in metal-to-metal contact of arm 20 with shaft 24 in member 22 (FIG. 5), from there via shaft 24 to member 30, and from thence via nose 114 of member 30 to a contact 116 which is connected to the terminal 118. The brake 82 has a metallic core 120 which is in conductive contact with the disks 98, 100; it is connected with contact 116 via a wire 122 in element 14 and a wire 124 in the bottom wall of housing 12, the wire 124 having an angled end portion 126 which engages the contact 116. The arm 46 extends through element 30 with which it has metal-to-metal contact and is thus grounded via element 30. Baffle 78 is connected with a wire 128 in element 16, and this wire is in turn in contact with the previously mentioned wire 124 (FIG. 3) and thus with contact 116.

THE OPERATION

Thread T is led through the device prior to start-up of the machine, in the manner described earlier. Arms 20 and 46 can be adjusted to the thread thickness and to the desired thread tension, by appropriate turning of the knobs 40 and 54, respectively. The brake 82 is adjusted, if necessary, by turning the nut 106. There is, of course, one of the inventive devices for each of the many threads T to be processed by the textile machine.

The machine is then started and textile production commences. If, in the course of this operation, the thread T parts or becomes too loose, the spring 32 snaps the arm 20 upwards, causing the cam 26 to turn (clockwise in FIG. 1) and to move the flexible contacts 68, 70 and 72 into engagement with one another. This causes lamp 74 to be energized as a visual signal and the textile machine to be shut down via the terminals 69, 71 and 73. The torque of the arm 20, i.e. its accommodation to the thread tension, is selected by appropriate tensioning of spring 32 via knob 40. Should it be necessary to change the inertia of the arm 20 to allow for different thread thicknesses, then the (wire) arm 20 is replaced with another arm having a different diameter. This is accomplished by detaching arm 20 and member 22 from shaft 24 and re-attaching the shaft 24 to a different member 22 carrying a different-diameter arm 20.

Should the moving thread T have a knot in it, the knot entrains the arm 46 as it passes between the portion 47 and the baffle 78. The entrained arm 46 is pivoted in clockwise direction and the omega spring 50 as a result snaps the cam 48 and arm 46 into their switching positions by turning cam 48 in clockwise direction and causing it to bring the contacts 68, 70, 72 into mutual engagement. The consequences of this are the same as described before. When the defect is cleared up the arm 46 is returned to its starting position by depressing the button 62. The distance between portion 47 and baffle 78 can be adjusted and thus set for yarns of different thickness (or for knots of different types) within a range of, say, 0.5–4 mm; this is accomplished by turning of knob 54.

The U-shaped brackets are removably snapped into appropriate recesses of the elements 14, 16. Where necessary, the thread-guiding components are so shaped (overlapping of portions) as to prevent the running thread from dropping or jumping out of them. The cover 110 is threaded to the housing; all other connections may (but of course do not need to) be made by push-pull connections, push-on connetions, snap connections or the like.

While the invention has been illustrated and described as embodied in a thread monitor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A thread monitor for use with textile machines, particularly knitting machines, comprising a thread brake for running thread; a knot sensor for detecting knots in the thread; means for detecting a loss of tension in the running thread, comprising a thread-engaging tension arm, a cam turnable to and from an activated position in which it interrupts an electrical circuit of the textile machine, a coupling element coupling said tension arm with said cam so that displacement of the tension arm from a monitoring position to an indicating position effects turning of said cam to the activated position thereof and spring means urging said tension arm to said monitoring position; said knot sensor including a sensing arm mounted for turning movement so as to be entrained when it encounters a knot in the running thread, a cam element coupled with said sensing arm and movable between a rest position and an operating position, an omega spring normally maintaining said cam element in said rest position but snapping it into said operating position in response to entrainment of said sensing arm, a thread baffle justaposed with a portion of said sensing arm with the thread being required to pass therebetween, and means for varying the distance between said portion and said thread baffle; and means for returning said sensing arm to said rest position thereof, said returning means including a slidable plunger engageable from the exterior of the monitor and operative for pushing against said sensing arm.

2. A thread monitor as defined in claim 1, wherein said spring means comprises a tension spring.

3. A thread monitor as defined in claim 2, further comprising a roll connected to said spring, and means for turning said roll so as to vary the tension of said spring.

4. A thread monitor as defined in claim 3, further comprising a gear connected with said roll for turning therewith, and a stationary detent adjacent said gear, said spring urging said gear into arresting engagement with said detent.

5. A thread monitor as defined in claim 1, said coupling element being of substantially cylindrical shape and having an axial slot extending from its periphery inwardly to at least the vicinity of a central longitudinal axis of the coupling element, and a radial bore extending from said periphery to said slot.

6. A thread monitor as defined in claim 1, said thread brake comprising two brake disks having juxtaposed surfaces between and in contact with which the running thread passes, one of said surfaces being smooth and the other of said surfaces being slightly rough.

7. A thread monitor as defined in claim 6, said thread brake further comprising adjustable biasing means which urges at least one of said brake disks against the other brake disk.

8. A thread monitor as defined in claim 7, said one brake disk being the brake disk having the roughened surface.

9. A thread monitor as defined in claim 1; and further comprising a grounding terminal electrically connected to said thread brake, knot sensor and detecting means so as to ground electrostatic charges forming in the monitor.

* * * * *